United States Patent [19]

Katoh

[11] Patent Number: 4,682,879

[45] Date of Patent: Jul. 28, 1987

[54] ELECTROPHOTOGRAPHIC COPIER

[75] Inventor: Itsurou Katoh, Nara, Japan

[73] Assignee: Sharp Kabushiki Kaisha, Osaka, Japan

[21] Appl. No.: 759,734

[22] Filed: Jul. 29, 1985

[30] Foreign Application Priority Data

Jul. 31, 1984 [JP] Japan ..... 59-163224
Jul. 31, 1984 [JP] Japan ..... 59-163225

[51] Int. Cl.[4] ..... G03G 15/00
[52] U.S. Cl. ..... 355/3; 355/3 CH; 355/14 E
[58] Field of Search ..... 355/3 R, 3 CH, 3 DD, 355/14 E, 15

[56] References Cited

U.S. PATENT DOCUMENTS 4,240,739 12/1980 Koumura et al. ..... 355/3 R
4,372,669 2/1983 Fantuzzo et al. ..... 355/3 R
4,579,440 4/1986 Katoh ..... 355/3 R

*Primary Examiner*—A. C. Prescott
*Assistant Examiner*—C. Romano
*Attorney, Agent, or Firm*—Birch, Stewart, Kolasch & Birch

[57] ABSTRACT

An electrophotographic copier including a combined charging and transferring unit which is positioned adjacent the exposure station of the copier. The illuminating device for reflecting light off of the image to be copied is located after the exposure station to reduce the distance between the charging and exposing steps so that dark decay of the photoconductor is substantially eliminated.

5 Claims, 1 Drawing Figure

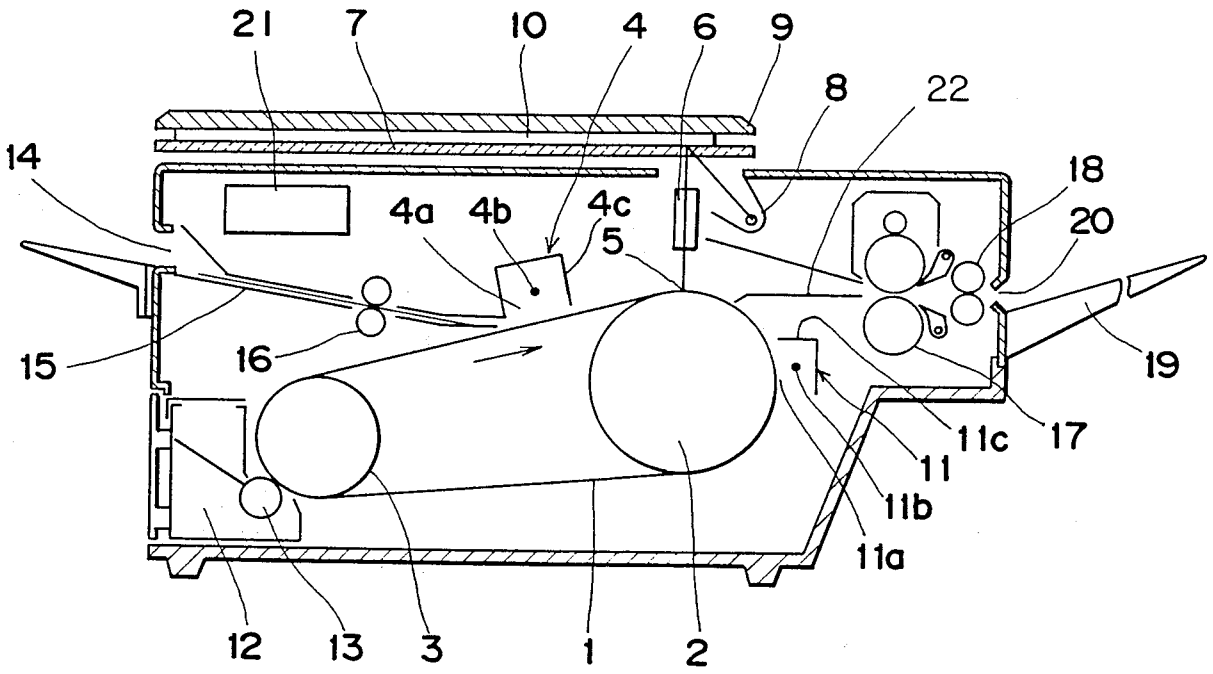
19
20
18
17
22
11c
11
11b
11a
8
9
6
2
4
4c
5
1
10
4b
4a
3
7
13
21
16
12
14
15

ELECTROPHOTOGRAPHIC COPIER

BACKGROUND OF THE INVENTION

1. Field of The Invention

The present invention relates to a copier which forms a latent electrostatic image on a recording medium in correspondence with the image of a document, develops the latent image with developer, transfers the developed image to a copy paper and fixes the image.

2. Related Art

In a copier which makes use of electrophotographic principles, units for charging, exposing, developing, transferring, discharging, cleaning and others are usually arranged in this order around a photoconductor as a recording medium.

Because units for the above-mentioned process steps are arranged around the photoconductor, the diameter of the rotary drum which supports the photoconductor cannot be made small, and the positions of the units are restricted.

A different kind of process called a two-rotation process has been applied to a copier as disclosed in Japanese patent publication No. 21706/1982. In this process, a single unit serves for both developing and cleaning. In the first rotation of the photoconductor the unit develops a latent electrostatic image formed on the photoconductor, while in the second rotation it removes toner and charge from the surface of the photoconductor at the same positions as that of developing the image.

An advantage of the two-rotation process is that number of the units can be decreased by one and the positions for the units can be determined with less restrictions.

Furthermore, both charging and transferring can be assigned to a single unit in this process. The photoconductor is charged homogeneously with a specified polarity in the charging process. Then, an optical image is exposed to form a latent image on the photoconductor. The latent image is developed by toner which has been charged for example by friction charging with a polarity opposite to the above-mentioned specified polarity. Then, the developed image is transferred to a copy paper charged with the appropriate specified polarity so as to transfer the toner thereto. The polarity of the charges both in the charging and transferring step is the same for each. This makes it possible to assign a single unit to both charging and transferring. Accordingly, the number of the units can be decreased further by one. A copier wherein the number of units is decreased as mentioned above has already been developed.

However, the assignment of charging and transferring to a single unit results in the following disadvantages. First, because the unit should be arranged after the unit for developing, the distance between the charging (transferring) position and the exposing position becomes necessarily long. Therefore, the dark decay after the homogeneous charging becomes large such that when the photoconductor arrives at the exposing position it becomes difficult to form a correct latent electrostatic image, and the contrast of the image decreases. Therefore, a photoconductive material having a low dark decay property should be used for a photoconductor. Second, the arrangement of a corona charging device for transferring becomes inappropriate, that is, since a copy paper which is usually fed horizontally is charged from the rear side thereof in the transferring process, the aperture of the corona charging device is opened upwardly in order to charge the copy paper. Then, a portion of the toner deposited on the photoconductor after the development falls into the corona charging device through the aperture thereof to soil the corona charging line. This invites serious irregular charging.

These disadvantages are related closely with the fact that a single unit is used both for charging and transferring, and they are difficult to overcome.

SUMMARY OF THE INVENTION

An object of the present invention is to provide a copier wherein the charging position is arranged near the exposing position by rearranging the units for electrophotographic imaging.

Another object of the present invention is to provide a copier wherein the aperture of a corona charging device for transferring can be opened downward.

It has been determined that the above-mentioned objects can be realized if a copy paper onto which a developed image is transferred is allowed to move over the exposing position of the photoconductor to a fixing unit.

The electrophotographic copier according to the present invention includes a photoconductor, a charging device which charges the photoconductor, an exposing device which exposes the photoconductor to an optical image to form a latent electrostatic image, the exposing device being arranged near the charging device, a developing system which develops the latent image, a fixing configuration which fixes the transferred image on the copy paper, and a cleaning device which cleans the photoconductor. The photoconductor and the above-mentioned charging, exposing and developing features are arranged so that the transferred image passes the exposing station on the photoconductor after completion of exposing to the optical image. The charging device serves to both charge the photoconductor uniformly prior to exposure selectively to the optical image and also to transfer the developed image to the copy paper. An illumination device is provided after the exposure station. The copier further includes a feeding system which carries copy paper to the charging (transferring) device, a controller which allows the feeding system to carry the copy paper to the charging (transferring) device synchronously with the movement of the photoconductor so as not to interfere with the exposing of a complete optical image to the photoconductor by the exposing device. The copy paper on which the developed image has been transferred follows a path so that the copy paper is carried over the exposing site to the fixing means.

One advantage of the present invention is that the dark decay becomes so negligible as to produce clear image formation upon exposure. Another advantage of the present invention is that the transferring unit can be prevented from being soiled so as to resume homogenous charging.

The objects and features of the invention may be understood with reference to the following detailed description of an illustrative embodiment of the invention, taken together with the accompanying drawing:

The FIGURE is a schematic cross-sectional view of a copier according to the present invention.

PREFERRED EMBODIMENT OF THE INVENTION

The FIGURE is a schematic diagram of a copier according to an embodiment of the invention to illustrate the inside of a copier. A photoconductor 1 is formed as an endless belt. It is tightened between a large roller 2 and a small roller 3 with an appropriate tension. A driver (not shown) drives the photoconductor 1 in a direction shown by the arrow or stops the photoconductor 1, for example, by driving the large roller 2. A corona charging device 4, which serves for both charging means and transferring means, is arranged above the upper run of the photoconductor 1 with its aperture 4*a* opening downward. An exposing site 5 of the optical image is determined so as to be positioned on the outer periphery of the large roller 2 just after the corona charging device 4. An optical image from a document is formed through a focusing phototransmitter (hereinafter referred to as lens array) 6 on the photoconductor 1 at the exposing site 5, the combination being characterized as an exposure station.

A document is put on a transparent glass plate 7 which constitutes a document platen. It is illuminated by a lamp of an illuminating device 8 which is set near the right-hand side of the lens array 6. A document cover 9, which can be opened or closed by a user, is provided over the transparent glass plate 7. It covers the whole transparent glass plate 7 by interposing a white mat 10 so that the document is pressed closely on the plate 7. The document platen, which includes the transparent glass plate 7, is moved in a longitudinal direction of the main body of the copier according to the movement of the photoconductor 1 by a driving force supplied from the main body. Then, an image of a document is formed through the lens array 6 on the photoconductor 1 successively to form a latent electrostatic image on the surface of the photoconductor 1.

An a.c. corona discharging device 11 which discharges the remaining charges on the surface of the photoconductor 1 is stationed after the exposing site 5 on the right-hand side of the large roller 2. The aperture 11*a* of the a.c. corona discharging device 11 also opens downward.

A developing unit 12 is provided near the small roller 3. The developing unit 12 has a developing roller 13 in a developing cell which contains developer (toner). The developing roller 13 consists of a cylindrical sleeve made of nonmagnetic material. A magnet is set inside the sleeve, and the magnet attracts developer magnetically on the sleeve. By rotating the sleeve, the developing roller 13 carries developer on the sleeve to the developing region in contact with the photoconductor 1, and carries it back to the developing cell after development. Thus, a latent electrostatic image formed on the photoconductor 1 is developed by the toner.

A feed path consists of a guide plate 15 and a pair of feed rollers 16. A copy paper is fed through the feed path to the corona charging device 4. The guide plate 15 guides a copy paper supplied from the entrance 14 to the corona charging device 4, the feed rollers 16 feeding the copy paper synchronously with the movement of the photoconductor 1. Thus, a copy paper is carried by the feed rollers 16 along the guide plate 15 to the position of the corona charging device 4.

Then, a developed image (toner image) formed on the photoconductor 1 is transferred to the copy paper electrostatically by the corona charging device 4. After transferring, the copy paper is carried over the exposing position 5, accompanied by the movement of the photoconductor 1. Then, the copy paper is released from the photoconductor 1 and moves to a pair of fixing rollers 17 arranged near the release point. Of the fixing rollers 17, at least one roller, which faces the transfer surface of the copy paper, is heated at a fixing temperature. Thus, heat fixes the toner image on the copy paper. After passing the fixing rollers 17, the copy paper is carried by a pair of exit rollers 18 through an exit 20 out to a copy tray 19 set outside the copier.

A controller 21 controls the electrophotographic processes. For example, the timing of the exposing is related to the movement of the document platen and the feed rollers 16 are allowed to carry a copy paper to the corona charging device 4 synchronously with the movement of the photoconductor so as not to interfere with the complete exposing of an optical image to the photoconductor 1.

The copier described above is operated as follows: A two-rotation process is adopted. The copy action of the copier starts when a copy start switch (not shown) is turned on. The photoconductor 1 is driven at a constant speed in the direction shown by the arrow in the FIGURE. In the first rotation, the photoconductor is charged homogenously to a specified polarity by the corona charging device 4. A belt-like photoconductor 1, for practical use, is usually made from zinc oxide or an organic semiconductor. The surface of such a photoconductor is charged negatively because the corona charging device 4 generates negative corona charge. However, the polarity of the charges may be positive according to the kind of photoconductor used. When the charged photoconductor 1 reaches the exposing site 5, the image of a document on the transparent glass plate 7 is exposed through the lens array 6 and a latent electrostatic image thereof is formed on the photoconductor 1. The document platen which comprises the transparent glass plate 7 is moved in the right-hand direction, in the FIGURE, according to the movement of the photoconductor 1 so that a latent image is formed successively on the photoconductor 1.

The photoconductor 1 on which a latent electrostatic image is formed passes by the a.c. corona discharging device 11, and reaches the developing roller 13 of the developing unit 12. The a.c. corona discharging device 11 is controlled to be in the inactive state when a latent electrostatic image is formed on the photoconductor 1, that is, in the first rotation of the photoconductor 1. Thus, a latent electrostatic image on the photoconductor 1 is not discharged by the a.c. corona discharging device 11. Then, the latent electrostatic image is developed by the developing unit 12. In other words, toner especially made of color pigment is electrostatically attracted to the latent electrostatic image formed on the photoconductor 1 because the toner is charged with a polarity opposite to that of the charges of the latent image. Thus, the latent electrostatic image is made visible by the toner.

When the toner image is carried to the corona charging device 4, the rotation of the photoconductor enters the second rotation. The toner image is brought into close contact with a copy paper fed synchronously to be transferred to the copy paper by the corona charging device 4. The copy paper has been fed into the entrance 14, and has waited once at the position of the feed rollers 16. When the photoconductor 1 carrying the developed image reaches a predetermined position, the copy paper waiting is carried to the transferring position of the corona charging device 4 by the feed rollers 16. The feed rollers 16 are controlled synchronously with the movement of the photoconductor 1 so that the start position of the image formation (exposing) of the photoconductor 1 is in accord with the start position of the copy paper in transferring. The copy paper is brought into close contact with the photoconductor 1 at the transferring position, and the back surface (surface on which the toner image is not formed) of the copy paper is charged by the corona charging device 4. Because the polarity of charges is the same both in charging and in transferring, the corona charging device 4 may be kept operating. The voltage applied to the charging line 4*b* can be adjusted at transferring if necessary. The corona charging device 4 charges the back surface so that the toner attracted to the photoconductor 1 are transferred electrostatically to the copy paper.

After transferring, the copy paper is carried with the rotation of the photoconductor 1. After the copy paper crosses the exposing site 5, it is separated from the photoconductor 1 in order to introduce the copy paper to the fixing rollers 17. The curvature of the roller 2 is made small enough for a copy paper not to follow the rotation of the photoconductor 1, but to be released naturally from the photoconductor 1 by the nature of the copy paper itself. If the copy paper is not released naturally, it may be stripped off by providing a separation means such as a separation claw just after the exposing site 5. The released paper which has a toner image transferred to the lower surface is directed to the fixing rollers 17. The rollers 17 hold the copy paper between them, and fix the toner image on the copy paper with heat. It is preferable that the fixing rollers 17 pass the copy paper at the same speed as or at a slower speed than the speed of the photoconductor 1. If the rollers 17 pull the copy paper, an incorrect transferring may result or a toner image, after transferring, may be disturbed, for example, by the contact with a guide plate 22. After passing the fixing rollers 17, the copy paper is carried out of the copier by the exit rollers 18 to the copy tray 19 through the exit 20.

A part of the toner not transferred in the transferring process and charges of latent image remain on the photoconductor 1 even after the photoconductor 1 passes the exposing site 5. First, the photoconductor 1 reaches the a.c. corona discharging device 11, which has been activated when the top of the image region reaches the corona discharging device 11 during the second rotation of the photoconductor or after the last end of the latent image region passes the corona discharging device 11 in the first rotation of the photoconductor 1. The remaining charges on the photoconductor 1 are discharged by the a.c. corona discharging device 11. Then, the photoconductor 1 rotates further to reach the developing unit 12. The developing unit 12 serves as a developer when a latent electrostatic image is formed on the photoconductor 1 in the first rotation, while it cleans the photoconductor 1 in the second rotation. The remaining toner is removed to be restored in the developing unit 12, that is, the remaining toner is attracted not by the photoconductor 1 but by the unit 12 because the a.c. corona discharging device 11 discharges charge on the surface of the photoconductor 1. In order to clean more effectively, a voltage which allows the remaining toner to be absorbed electrostatically is preferably applied to the developing roller 13.

The a.c. corona discharging device 11 and the developing unit 12 is activated until the bottom of the image formation region on the photoconductor 1 passes them, and they are inactivated, for example, after the last end of the region passes them. If the top of the image forming region of the photoconductor 1 reaches the corona charging device 4 while the bottom of the image formation region does not pass the developing unit 12, the photoconductor 1 continues to rotate further. In the third rotation of the photoconductor 1, the corona charging device 4 is controlled to be inactive. Then, if the bottom of the image formation region passes the developing unit 12, the developing unit 12 is also set to be inactive. Finally, when the initial position of the photoconductor 1 is detected, the photoconductor 1 is stopped, and all of the copy processes are stopped. In other words, one copy cycle ends when the photoconductor 1 rotates three times. However, one copy cycle may end in the second rotation. In the case of multi-copying, a new copy cycle may start in the third rotation.

In the preferred embodiment of the present invention mentioned above, a copy paper, after transferring, is allowed to cross the exposing site 5 to the fixing rollers 17. Therefore, the corona charging device 4 which serves for both charging and transferring can be arranged near the exposing site 5. Then, the dark decay, after the homogenous charging, does not arise until the exposing site 5 so that sufficient electrostatic contrast can be obtained.

Furthermore, if the optical image of the document is allowed to illuminate the photoconductor 1 from an upper direction, as for the photoconductor 1, the aperture 4*a* of the corona charging device 4 can be arranged to open downward. Then, the corona charging line 4*b* and the inner face of the shield plate 4*c* of the device 4 are prevented from being soiled by toner which may fall from the surface of the photoconductor 1 so that the charging of the photoconductor 2 is always kept homogeneous without irregular charging.

In this embodiment, the a.c. corona discharging device 11 is stationed at the side of the large roller 2, and the aperture 11*a* opens almost horizontally. Furthermore, the lower part of the shield plate 11*c* of the a.c. corona discharging device 11 is cut open. Therefore, the shield plate 11*c* and the corona charging line 11*b* can be prevented from being soiled due to the falling of toner.

The a.c. corona discharging device 11 can also be stationed conveniently just after the exposing site 5. Then, the shield plate 11*c* needs no cutting, and the aperture 11*a* would open downward.

In the above-mentioned embodiment, a belt-like photoconductor 1 is used for image-formation process. However, the present invention can also be applied to a drum-like photoconductor.

The photoconductor 1 can be discharged by the a.c. corona discharging device in this embodiment. However, the discharging can be made more effective if the illumination is accompanied by a.c. corona discharge. In this embodiment, the exposing site 5 is arranged near the corona charging device 4 which serves for both charging and transferring, and a copy paper is arranged to be carried over the exposing site 5 to the fixing rollers 17 after the developed image has been transferred onto the copy paper. Thus, the dark decay after the homogeneous charging by the corona charging device 4 does not arise, and sufficient electrostatic contrast can be realized in exposing.

Furthermore, because the photoconductor 1 can be illuminated at the exposing site 5 from above, the corona charging device 4 which serves for both charging and transferring can be arranged so that the opening 4*a* opens downward. Then, soiling of the corona charging device 4 by falling toner can be prevented, and the photoconductor 1 always is charged homogeneously.

While the embodiment of the present invention as herein disclosed constitutes a preferred embodiment, it is to be understood that other forms might be adopted.

What is claimed as new:

1. A electrophotographic copier for implementing an electrophotographic copying process, comprising in combination:

a photoconductor;

a charging means for uniformly charging said photoconductor and for transferring an image to be developed on said photoconductor to a copy paper;

an exposing means for exposing said charged photoconductor to an optical image at an exposure site of an exposure station to form a latent electrostatic image thereon, said exposing means being juxtapositioned to said charging means at a distance such that dark decay of said photoconductor before exposure is substantially eliminated;

a developing means which develops said latent image with toner particles;

an illuminating means positioned after said exposure means;

a fixing means which fixes said transferred toner particles in an imagewise manner to said copy paper;

a cleaning means which cleans said photoconductor, a feeding means which carries said copy paper to said charging means during the image transfer phase of said copying process; and a means for controlling the feeding means to transport a copy paper to the charging means synchronously with the movement of said photoconductor so as not to interfere with exposing of a complete optical image to said photoconductor by said exposing means said photoconductor, charging means, exposing means and fixing means being adjusted to said feeding means such that copy paper with the transferred image thereon passes said exposure station after completion of exposure of said optical image;

said copy paper following a path so as to be transported over said exposure site to said fixing means.

2. An electrophotographic copier according to claim 1, wherein said exposing means is arranged to illuminate a site on said photoconductor in an incident direction above a horizontal plane.

3. An electrophotographic copier according to claim 1, wherein said photoconductor is belt-like.

4. An electrophotographic copier according to claim 1, wherein said photoconductor is drum-like.

5. An electrophotographic copier according to claim 1, wherein said charging means has an opening which opens downward.

* * * * *